United States Patent [19]

Nelson et al.

[11] 4,135,577

[45] Jan. 23, 1979

[54] TOOL CENTRALIZER GUIDE HAVING A J-GROOVE RELEASE

[75] Inventors: Paul M. Nelson; Carl P. Hutchinson, both of Houston, Tex.

[73] Assignee: Wilson Industries, Inc., Houston, Tex.

[21] Appl. No.: 795,950

[22] Filed: May 11, 1977

[51] Int. Cl.[2] ..... E21B 23/00

[52] U.S. Cl. ..... 166/241; 175/325; 166/240

[58] Field of Search ..... 166/240, 241, 242; 175/325, 317; 285/361, 396, 402; 308/46

[56] References Cited

U.S. PATENT DOCUMENTS

| | | | |
|---|---|---|---|
| 1,874,673 | 8/1932 | Waters | 166/240 X |
| 2,035,637 | 3/1936 | Crickmer | 166/241 |
| 2,429,910 | 10/1947 | Anderson et al. | 166/240 X |
| 3,329,209 | 7/1967 | Kisling | 166/240 X |
| 3,386,764 | 6/1968 | Evans | 166/240 X |

*Primary Examiner*—Ernest R. Purser
*Assistant Examiner*—Nick A. Nichols, Jr.
*Attorney, Agent, or Firm*—Arnold, White & Durkee

[57] ABSTRACT

A centralizer apparatus for guiding, within a well bore, a tool having a radially outwardly extending member thereon includes a sleeve concentrically disposed about the tool. The sleeve has a downwardly opening, substantially J-shaped groove therein sized to receive the radially outwardly extending member on the tool about which the sleeve is disposed. The J-groove has a first, closed, axially-extending slot portion and a second, axially-extending slot portion opening at the downstring end of the sleeve. The first and second axially extending slot portions of the J-groove are spaced circumferentially apart and communicate through a substantially transverse slot portion. An outer protective jacket is provided about the sleeve. A centralizer guide depends from the lower end of the jacket to contact the walls of the bore and maintain the tool centrally with respect thereto.

4 Claims, 5 Drawing Figures

TOOL CENTRALIZER GUIDE HAVING A J-GROOVE RELEASE

FIELD OF THE INVENTION

This invention relates to downhole well tools and, in particular, to a centralizer with a downwardly opening J-groove therein.

BACKGROUND OF THE INVENTION

During drilling operations it sometimes occurs that portions of the drill string become trapped or lodged within the well bore. These entrapped or lodged portions of the drill string are known to those skilled in the art as "fish". It at times becomes necessary to insert into the bore from the surface any one of a number of so-called "fishing tools" in order to retract the fish from the bore. The fishing tool is lowered into the bore at the end of a suitable work string for the purpose of securely engaging the fish to permit the extraction thereof.

It sometimes happens, however, that the fishing tool may stray from the axial centerline of the bore. Thus, the fishing tool may possibly miss engagement with the axial opening provided within the fish. To obviate such difficulties, the prior art provides a centralizer guide which is typically fixed to the work string by a shear pin. The purpose of the centralizer guide is to provide a flared element of sufficient diameter to engage the well bore and to maintain central axial alignment of the fishing tool as it is lowered into the bore.

Once the fishing tool has been guided to the proximity of the fish, the tool may enter the central opening thereof. Further axial advancement of the tool in the downstring direction severs the shear pin and permits the fishing tool to further penetrate the fish to secure it for extraction purposes.

However, if after the shear pin is broken the fish becomes disengaged, the centralizer is no longer effective as a guide. As a result, the entire string must be retracted to provide a new centralizer guide on the string.

Alternatively, it is possible that during the insertion of the string into the bore, the centralizer may encounter a protrusion or other imperfection within the surface of the bore sufficient to shear the pin prior to the engagement of the tool with the fish. Again, the entire work string must then be retracted and the centralizer guide replaced in order to successfully continue fishing operations. Of course, such retractions and reinsertions necessarily increase the cost of fishing operations.

The prior art, as exemplified by U.S. Pat. No. 3,785,690 (Hutchinson), assigned to the assignee of the present invention, discloses an overshot tool having a J-groove machined into the exterior surface thereof. The J-groove opens axially upwardly and receives a radially inwardly extending lug provided on the interior surface of an overshot. Various other prior art patents disclose substantially downwardly opening J-grooves. For example, U.S. Pat. Nos. 3,082,831 (LeBus, Senior), 3,223,169 (Roark) and 3,248,129 (Brown) disclose J-grooves opened at both axial ends thereof. U.S. Pat. Nos. 3,223,169 (Roark), 3,308,886 (Evans) and 3,386,764 (Evans) disclose downhole tools having J-grooves opening only in the downhole direction.

In view of the foregoing, it is advantageous to provide an overshot centralizer for guiding and maintaining a tool centrally and axially as the tool proceeds in the downstring direction within a well bore having a sleeve concentrically surrounding the tool and receiving therein a radially outwardly extending lug. It would be of further advantage to provide the sleeve with a substantially downwardly opening J-groove in which the lug is receivable. It would be of still further advantage to provide the downwardly opening J-groove such that the closed axial portion of the groove is spaced circumferentially from the downwardly opening lug thereof so that the tool may be alternatively disengageable from the centralizers to permit further axial advancement thereof or, engagable in a driving relationship with the centralizer to overcome obstructions with the bore.

SUMMARY OF THE INVENTION

This invention relates to a centralizer adapted for use with a fishing tool to maintain the tool centrally and axially with respect to a well bore as the tool is lowered thereinto. The centralizer comprises a substantially axially extending sleeve concentrically disposed about the tool. The sleeve has a downwardly opening J-groove opening therein. The J-groove is sized to receive a radially outwardly extending lug provided on the exterior surface of the tool. An outer jacket concentrically surrounds the inner sleeve. Centralizer guides depend from the lower axial end of the jacket to maintain the tool on a central axial course as the tool moves in the downhole direction. The J-groove includes an axially extending closed slot portion and circumferentially spaced, axially extending, downwardly opened slot portion. The axially extending slot portions are connected by a transverse slot.

The centralizer receives the lug on the tool with the J-groove such that the centralizer is selectively disengagable from or drivable by the tool. Normally, the centralizer hangs axially from the tool with the lug disposed at the uppermost section of the closed slot portion of the J-groove. When the centralizer becomes obstructed on imperfections in the bore, continued axial advancement of the tool in the downhole direction moves the lug into the lower axial end of the closed slot portion to thereby place the centralizer into driven engagement by the tool. Application of a sufficient force overcomes the obstruction to permit continued advancement of the centralizer. In the alternative, when it is desired to disengage the tool from the centralizer, axial downstring movement coupled with angular rotation of the tool moves the lug out the downstring open end of the J-groove to permit the tool to advance to the exclusion of the centralizer. Yet further, when it is desired to re-engage the tool with the centralizer, an axial upstring movement coupled with an opposite-angular rotation re-engages the tool with the J-groove of the centralizer.

BRIEF DESCRIPTION OF THE DRAWINGS

The invention will be more fully understood from the following detailed description of a preferred embodiment thereof, takin in connection with the accompanying drawings, in which.

DESCRIPTION OF THE PREFERRED EMBODIMENT

Figure 1:
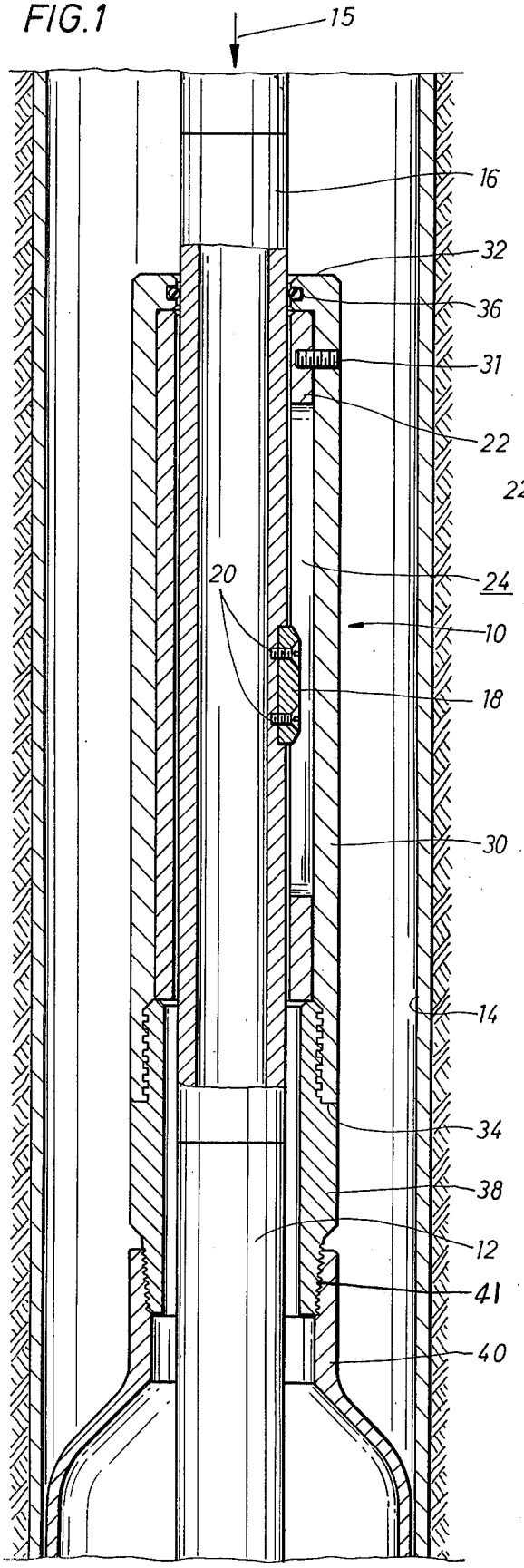
FIG. 1 is an elevational view, entirly in section, of a centralizer guide embodying the teachings of this invention.

Throughout the following description similar reference numerals refer to similar elements in all figures of the drawings.

Referring first to FIG. 1, an elevational view, entirely in section, of a centralizer tool 10 embodying the teachings of this invention is shown. The centralizer 10 is provided to maintain central, axial alignment of a well fishing tool 12 to which it is attached as the tool 12 is moved axially downward in a well bore 14 (downhole direction 15). The tool 12 is usually attached at the lower end of a work string 16 extending from the surface.

The fishing tool 12 has a radially outwardly extending lug 18 affixed to the exterior surface thereof by suitable means, as bolts 20. The lug 18 extends radially beyond the basic diameter of the tool 12 and is received within the centralizer 10 in a manner made clearer herein.

The centralizer 10 generally comprises an inner sleeve 22 in which is provided an axially downwardly opening J-groove 26. The sleeve 22 has first and second axial ends 24 and 28, respectively. The lug 18 is slidably received within the J-groove 24. Concentrically disposed surrounding the inner sleeve 22 is a protective outer jacket 30. The jacket 30 may be keyed or otherwise attached to the sleeve 22 for the purpose of making the sleeve and jacket integral. In FIG. 1, a set screw 31 is shown for this purpose, although other expedients may be utilized. The jacket 30 has first and second axial ends 32 and 34 respectively thereon. The purpose of the jacket 30 is to seal and protect the J-groove 24 provided within the sleeve 22 from becoming corroded with foreign matter. The jacket 30 also serves to facilitate the manufacture or repair of the tool in that provision of a jacket allows the J-groove 24 therein to be milled or otherwise disposed in the sleeve 22 from the outside of the tool. The jacket 30 also serves to strengthen and support the sleeve 22. Suitable seals 36 may be provided. Threadedly engaged at the lower, second axial end 34 of the jacket 30 is a sub 38. As noted, the sub 38 may be keyed or otherwise attached to the jacket 30, as by a notched insertion between the sleeve 22 and the sub 38, (as shown only by way of example in dot-dash lines in FIG. 3B). The sub 38 is in turn connected as by threads 41 to a centralizer guide member 40. The centralizer guide member 40 is a radially flared member (relative to the center line of the bore) and fits in close juxtaposition with the bore to minimize the annular space between the guide and the bore and to center the tool within predetermined limits to prevent sticking or swabbing. Although shown in the Figures as attached to the axially lower end of the centralizer, it is understood that the flared member 40 may be attached at any axially position thereon. The guide 40 may be any suitable centralizer commonly available, for example, oversized but cut-lipped, toothed, skirted, or any combination of these or others. The guide may be of any predetermined length, able to scoop a fish and center the same for example, if such an operation be desired. By providing the threaded engagement or other suitable attachment, as at 41, flexibility of operation due to interchangeability of guides 40, is built into the tool embodying these teachings.

Figure 2:
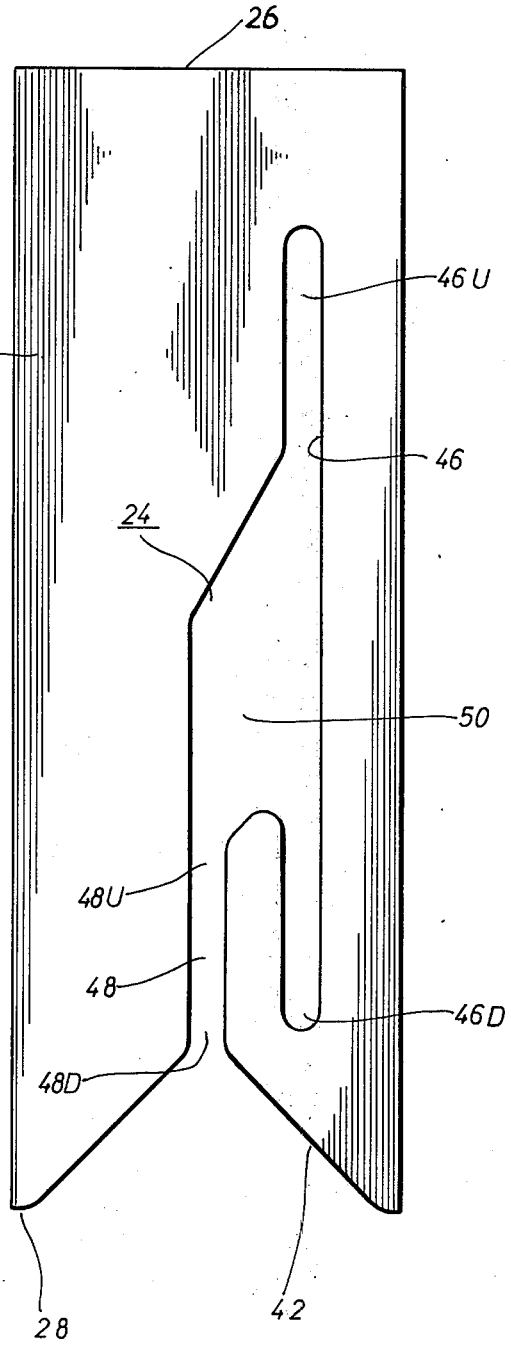
FIG. 2 is a fully developed view of a portion of the centralizer embodying the teachings of this invention; and, FIGS. 3A through 3C are pictorial representations of the modes of operation of a centralizer embodying the teachings of this invention.

With reference to FIG. 2, a fully developed view of the sleeve 22 is shown. As there seen, the sleeve 22 has the J-groove opening adjacent the downstring end 28 thereof. The open end of the J-groove is an inclined opening, or muleshoe arrangement 42.

The J-groove 24 includes a first, axially extending closed slot portion 46 and a second, axially extending opened slot portion 48 spaced circumferentially therefrom. Communication between the first and second axial portions 46 and 48, respectively, is provided by a transverse connecting slot portion 50. The transverse connecting portion 50 communicates with the upper end of the second axial portion and substantially the central portion of the first axial slot. For reference, the axial upstring and downstring ends of the closed slot 46 is indicated by numerals 46U and 46D, respectively. The upstring and downstring ends of the open slot 48 are respectively indicated by numerals 48U and 48D, respectively. The end 48D of the slot 48 opens into the muleshoe 42. The tool embodying the teachings of this invention permits ease of disengagement and re-engagement and permits transmission of torque in either rotational direction with the lug 18 in either the ends 46U or 46D of the closed slot.

Although it is appreciated that the transverse communicating slot 50 may connect any portions of the first and second axial slots 46 and 48, the slot 50 is disposed between the central section of the first slot 46 and the upstring end 48U of the open slot 48.

Figure 3A:
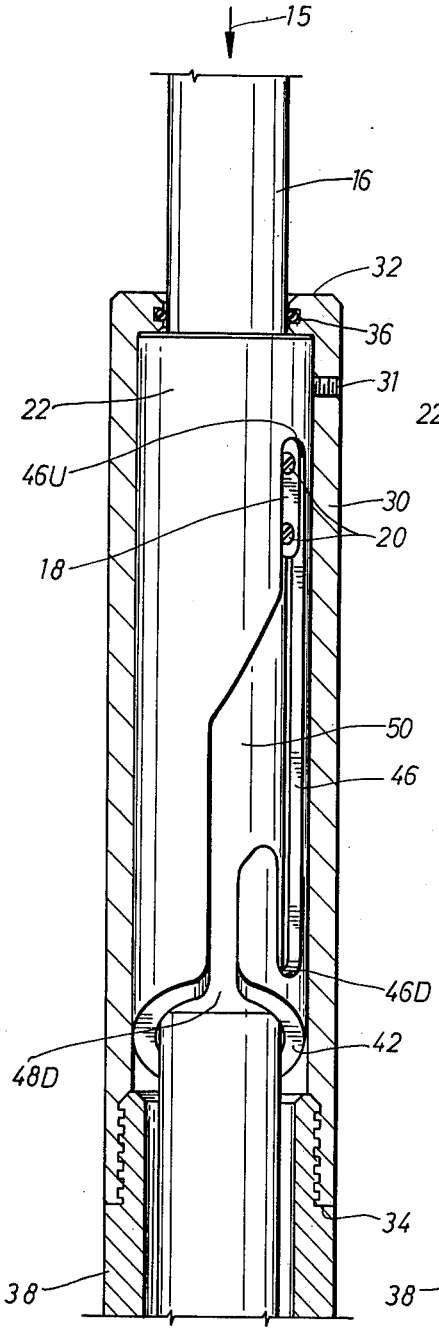
Figure 3B:
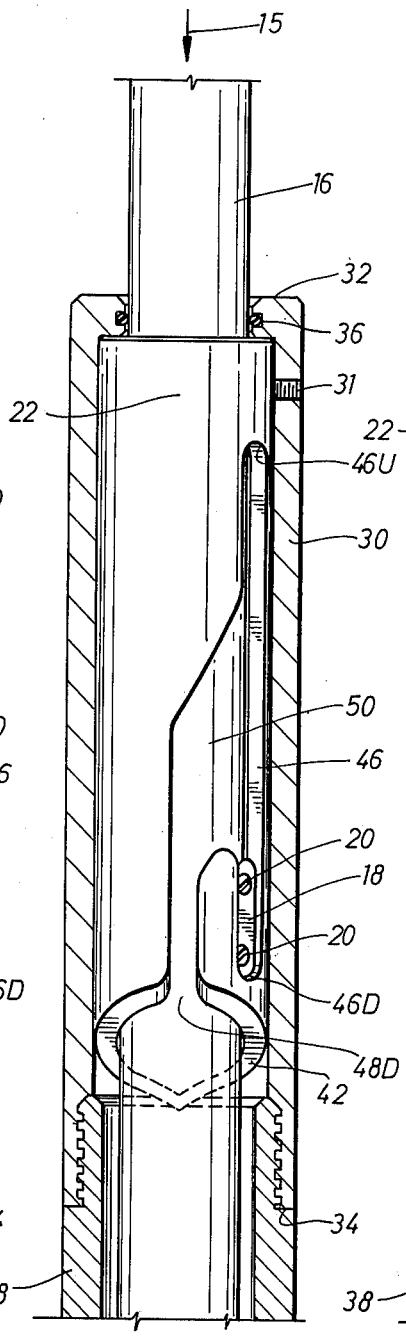
Figure 3C:
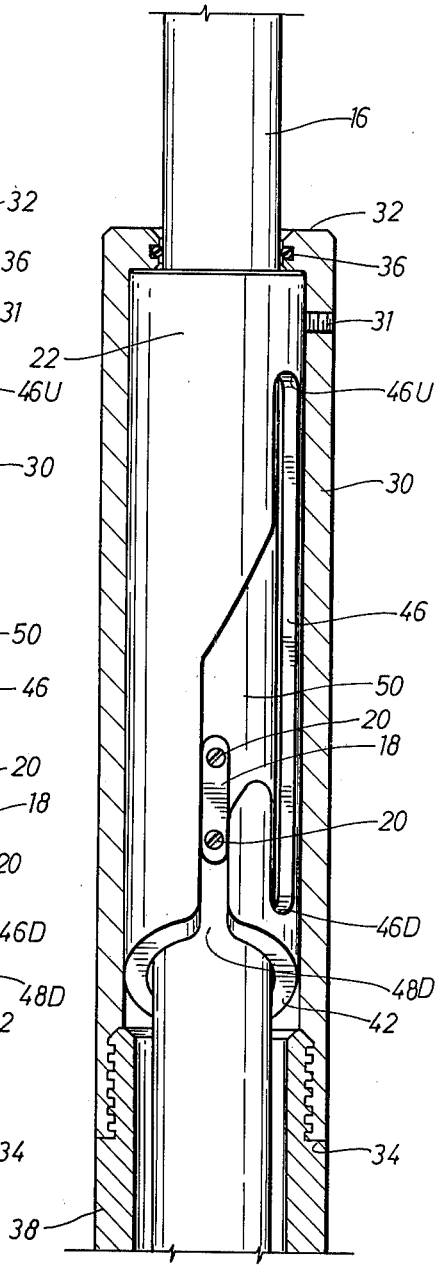

In operation, with reference to the pictorial representation shown in FIG. 3A, the sleeve 22 normally surrounds the tool 12 with the radially outwardly projecting lug 18 received within the upper, closed end 46U thereof. Normally, therefore, the centralizer guide 10 hangs axially from the lug 18 and is supported thereby. Thus, as the tool 12 moves in the downhole direction 15, the centralizer guide 10 dependent therefrom acts to maintain centricity and axial alignment of the tool 12 with respect to the bore 14.

When it becomes apparent that the centralizer guide 10 is obstructed on an imperfection within the bore 14, continued axial advancement of the tool 12 disposes the lug 18 within the lower closed end 46D (FIG. 3B) of the first axial slot 46. This disposition places the work string into driving engagement with the centralizer guide 10. An axially downstring directed force on the work string is directly transmitted to the centralizer guide 40 to overcome the obstruction within the bore 14. It may be appreciated that once the obstruction has been overcome, the force of gravity draws the centralizer guide 10 in a downhole direction to again dispose the lug 18 in the normal position at the upstring end 46U of the slot 46.

If it is desired to disengage the tool 12 from the centralizer guide 10, the tool is moved in downstring direction a predetermined distance so as to axially dispose the lug 18 at the intersection of the first axial slot 46 and the transverse slot portion 50. Downhole movement, coupled with a predetermined angular rotation of the work string, moves the lug 18 out the open end 48D of the J-groove 24 and permits continued axial advancement of the tool 12 independently of the centralizer guide 10. Such disengagement would, for example, occur when the fish has been engaged by the tool 12 and it is desired to further advance the fishing tool into the fish to more securely affix it thereto. In practice, it may be desirable to simultaneously impose an axial downward and a slight right-handed (clockwise) rotation simultaneously on the tool, to move the lug 18 downwardly (under the influence of the axial force) until it comes into proximity to the transverse slot 24 where the rotational force will move it into the open slot 48.

If it is desired to re-engage the tool 12 with the centralizer 10, it is merely necessary to impose an axially upstring-directed force on the tool 12 to bring the lug 18 into contact with the muleshoe surface 42. This surface 42 acts to guide the lug 18 into the second axially extending slot 48 of the J-groove 24. The upstring directed force, when coupled with a counter-rotation of the tool 12, redisposes the lug 18 into its normal carrying position in the upper, closed end 46U of the first axially extending slot 46.

It may be appreciated from the foregoing description that a centralizer guide is provided which permits selective disengagement and re-engagement of a centralizer member with a downhole tool. It is also seen that the tool may also be placed selectively into driving engagement with the centralizer guide to overcome obstructions to downhole advancement of the tool. Implicit throughout the foregoing description is the fact that at no time does severance between the tool and the centralizer occur. It may thus be appreciated that a centralizer guide embodying the teachings of this invention provides all the advantages and overcomes all the disadvantages of the prior art.

It is understood that although those skilled in the art may provide modifications hereto in view of these teachings, these modifications are within the contemplation of this invention, as defined in the appended claims.

What is claimed is:

1. Apparatus for centrally guiding within a well bore a tool having a radially outwardly extending lug member thereon comprising:

a substantially cylindrical sleeve sized to concentrically fit about a tool having a radially outwardly extending lug thereon, said sleeve having a groove therein sized to receive the lug, said groove including a first, axially extending, closed slot and a second, axially extending open slot, said axially extending slots being circumferentially spaced from each other, and a transverse slot connecting said first to said second axially extending slots;

an outer jacket mounted concentrically about said sleeve and adapted to totally enclose said slots disposed therein; and, a radially flared centralizer element mounted to said sleeve, said centralizer disposed so as to fit within close juxtaposition with the well bore to minimize the annular space between the centralizer and the bore adjacent all points along the radially outward edge thereof to maintain said jacket and sleeve centrally located with respect thereto.

2. Apparatus according to claim 1, wherein said first axially extending closed slot has an upper and lower end therein, reception of the lug member within said lower end of said first slot disposing said sleeve and said centralizer element mounted thereto into an axially and rotary driven relationship with the tool.

3. Apparatus according to claim 1 wherein said jacket has an axially upper and axially lower end thereon further comprising seal means disposed between said upper axial end of said jacket and the tool for preventing entry of well materials into the grooves disposed within said sleeve.

4. Apparatus according to claim 3, wherein said centralizer element is threadedly affixed to said lower end of said jacket.

* * * * *